US010992093B1

(12) United States Patent
Lee et al.

(10) Patent No.: US 10,992,093 B1
(45) Date of Patent: Apr. 27, 2021

(54) UNIVERSAL ADAPTER STRUCTURE

(71) Applicants: Yueh-Ying Lee, New Taipei (TW); Yueh-Hui Lee, New Taipei (TW)

(72) Inventors: Yueh-Ying Lee, New Taipei (TW); Yueh-Hui Lee, New Taipei (TW)

(73) Assignee: YANG JI CO., LTD., New Taipei (TW)

( * ) Notice: Subject to any disclaimer, the term of this patent is extended or adjusted under 35 U.S.C. 154(b) by 0 days.

(21) Appl. No.: 16/798,125

(22) Filed: Feb. 21, 2020

(51) Int. Cl.
*H01R 31/06* (2006.01)
*H01R 27/00* (2006.01)

(52) U.S. Cl.
CPC ..... *H01R 31/06* (2013.01); *H01R 27/00* (2013.01)

(58) Field of Classification Search
CPC ..... H01R 31/06; H01R 31/065; H01R 27/00; H01R 35/04
See application file for complete search history.

(56) References Cited

U.S. PATENT DOCUMENTS 5,611,701 A * 3/1997 Hahn ..... H01R 24/66 439/131
5,791,921 A * 8/1998 Lee ..... H01R 27/00 439/103
7,354,286 B1 * 4/2008 Lee ..... H01R 13/652 439/131
9,331,441 B2 * 5/2016 Roy ..... H01R 13/434

* cited by examiner

*Primary Examiner* — Oscar C Jimenez
(74) *Attorney, Agent, or Firm* — Che-Yang Chen; Law Office of Michael Chen

(57) ABSTRACT

A universal adapter structure comprises a housing, a socket unit, a first plug unit and a second plug unit. The first and the second plug units have a rocking base, two plug terminals and a driving member, respectively. The rocking base is pivotally disposed on the housing, the two plug terminals are fixed on the rocking base, and the driving member is movably disposed on the housing. By pressing the driving member, the rocking base can be pivoted, thereby driving an outer end of the plug terminal to pivot toward a direction away from the housing.

17 Claims, 8 Drawing Sheets

UNIVERSAL ADAPTER STRUCTURE

BACKGROUND OF THE INVENTION

Field of Invention

The present invention relates to an electrical appliance, and more particularly to a universal adapter structure.

Related Art

Plug adapter is an indispensable item in international travel. It provides the most basic plug form conversion for electrical products, so that the plug and socket with two different specifications can form an electrical connection, and the electrical product can obtain an electric power source. The inventor of the present invention has been committed to the development of adapters for a long time, and has obtained many patents in Taiwan including: I508398, I445263, M474287, and I406463.

In order to facilitate portability, the plug terminals of the conventional adapter are accommodated in a groove provided on the housing of the adapter when not in use. When a user wants to use the plug terminals, the terminals are pulled out by applying a force by a finger to the terminals. For users with thick fingers or weak fingers, it is not an easy task to pull out the plug terminals of the conventional adapter. In addition, since most European sockets have a recessed circular block (such as a European socket 84 shown in FIG. 8), and the exterior of the conventional adapter is mostly a cube structure, when the adapter is used in the European socket, the pins of the adapter will be partially suspended in the circular block, resulting in poor adapter robustness and being easily shaken by slight external force.

SUMMARY OF THE INVENTION

In view of the above-mentioned, an object of the present invention is to provide a universal adapter structure, in addition to having a structure capable of simply flipping plug terminals to be in a ready-to-use state, the structure is also capable of improving the robustness when applied to a European socket.

In order to achieve the aforementioned object of the present invention, the present invention provides a universal adapter structure comprising: a housing having an accommodating space therein, and a plurality of socket openings on one side; a socket unit having a plurality of socket terminals; the socket terminals are located in the accommodating space of the housing and correspond to the socket openings respectively; and a first plug unit disposed on the housing and having a first rocking base, a plurality of first plug terminals and a first driving member; the first rocking base has a first shaft, a first driving portion and a plurality of first fixing portions; the first rocking base is pivotally disposed to the housing with the first shaft and along a first axial direction; the first driving portion is spaced a predetermined distance from the first axial direction; the first plug terminals are connected to the first fixing portions of the first rocking base, and are electrically connected to the socket terminals of the socket unit respectively; the first driving member is movably disposed on the housing; the first driving member has a first butting portion corresponding to the first driving portion of the first rocking base.

After the first driving member is moved, the first butting portion is pressed against the first driving portion of the first rocking base to apply a torque to the first rocking base and to pivot the first rocking base, thereby causing outer ends of the two first plug terminals to pivot toward a direction away from the housing.

In one embodiment, the housing is provided with a track, the first driving member is provided with a first guide portion combined with the track, so that the first driving member moves along the track.

In one embodiment, the housing is provided with a notch, and the first driving member is disposed in the notch.

In one embodiment, the housing is provided with a plurality of first plug terminal slots, in an initial state, the first plug terminals are accommodated in the first plug terminal slots.

In one embodiment, the first rocking base of the first plug unit has a first main section and two first extend sections located at two ends of the first main section respectively and extending along a direction approximately perpendicular to the first main section; the first driving portion and the first fixing portion are disposed on the first main section, and the two first extend sections are respectively provided with the first shaft.

In one embodiment, the first fixing portion is a screw hole, a locking member passes through the first plug terminal, and then is locked into the screw hole.

In one embodiment, further comprises a second plug unit disposed on the housing, the second plug unit has a second rocking base, a plurality of second plug terminals, and a second driving member; the second rocking base has a second shaft, a second driving portion, and a plurality of second fixing portions; the second rocking base is pivotally disposed to the housing with the second shaft and along a second axial direction; the second driving portion is spaced a predetermined distance from the second axial direction; the second plug terminals are connected to the second fixing portions of the second rocking base, and are electrically connected to the socket terminals of the socket unit respectively; the second driving member is movably disposed on the housing; the second driving member has a second butting portion corresponding to the second driving portion of the second rocking base; after the second driving member is moved, the second butting portion is pressed against the second driving portion of the second rocking base to apply a torque to the second rocking base and to pivot the second rocking base, thereby causing outer ends of the two second plug terminals to pivot toward a direction away from the housing.

In one embodiment, a pivoting direction of the first plug terminal of the first plug unit is opposite to a pivoting direction of the second plug terminal of the second plug unit.

In one embodiment, the housing is provided with a track, the second driving member is provided with a second guide portion combined with the track, so that the second driving member moves along the track.

In one embodiment, the housing is provided with a notch, and the second driving member is disposed in the notch.

In one embodiment, the housing is provided with a plurality of second plug terminal slots, in an initial state, the second plug terminals are accommodated in the second plug terminal slots.

In one embodiment, the second rocking base of the second plug unit has a second main section and two second extend sections located at two ends of the second main section respectively and extending along a direction approximately perpendicular to the second main section; the second driving portion and the second fixing portion are disposed on the second main section, and the two second extend sections are respectively provided with the second shaft.

In one embodiment, the second fixing portions are respectively a tube, and the second plug terminals are respectively inserted into the tubes and fixed.

In one embodiment, the second plug unit further comprises a plurality of auxiliary ribs pivotally disposed on the second rocking base; the auxiliary ribs abut the second plug terminals.

In one embodiment, each of the auxiliary ribs has a slot facing one of the second plug terminals, so that a portion of each of the second plug terminals is located in the slot of the auxiliary rib respectively.

In one embodiment, further comprises a ground terminal pivotally disposed on the housing.

In one embodiment, the housing is provided with a ground terminal slot, in an initial state, the ground terminal is accommodated in the ground terminal slot.

The above technical means allow users to flip the plug terminals out with a simple operation mode to avoid the problem that some users cannot flip the plug terminals out when using a conventional adapter, and improve the stability when used in a European socket.

The objects and efficacies of the present invention will be described below in detail in accordance with the preferred embodiments with reference to the drawings.

DETAILED DESCRIPTION OF THE INVENTION

In the following, different specific embodiments are listed and described in more detail for the implementation forms of the present invention in order to make the spirit and content of the present invention more complete and easy to understand; however, those having ordinary skills in the art should understand that the present invention is assuredly not limited to the embodiments, and other identical or equivalent functions and sequence of steps can be used to achieve the present invention.

In this specification, the meanings of the scientific and technical terms used herein are the same as those understood and commonly used by those having ordinary skills in the technical field to which the present invention pertains. In addition, when not contradicting with the context, the singular noun used in this specification covers the plural form of the noun; and the plural noun used also covers the singular form of the noun.

Furthermore, the directional terms mentioned in the following embodiments, for example: "above", "below", "left", "right", "front", "rear", etc., are only directions referring in the accompanying drawings. Therefore, the directional terms are used to illustrate, but not to limit the present invention. In addition, in the following embodiments, the same or similar elements will be labeled with the same or similar numerals.

Figure 1:
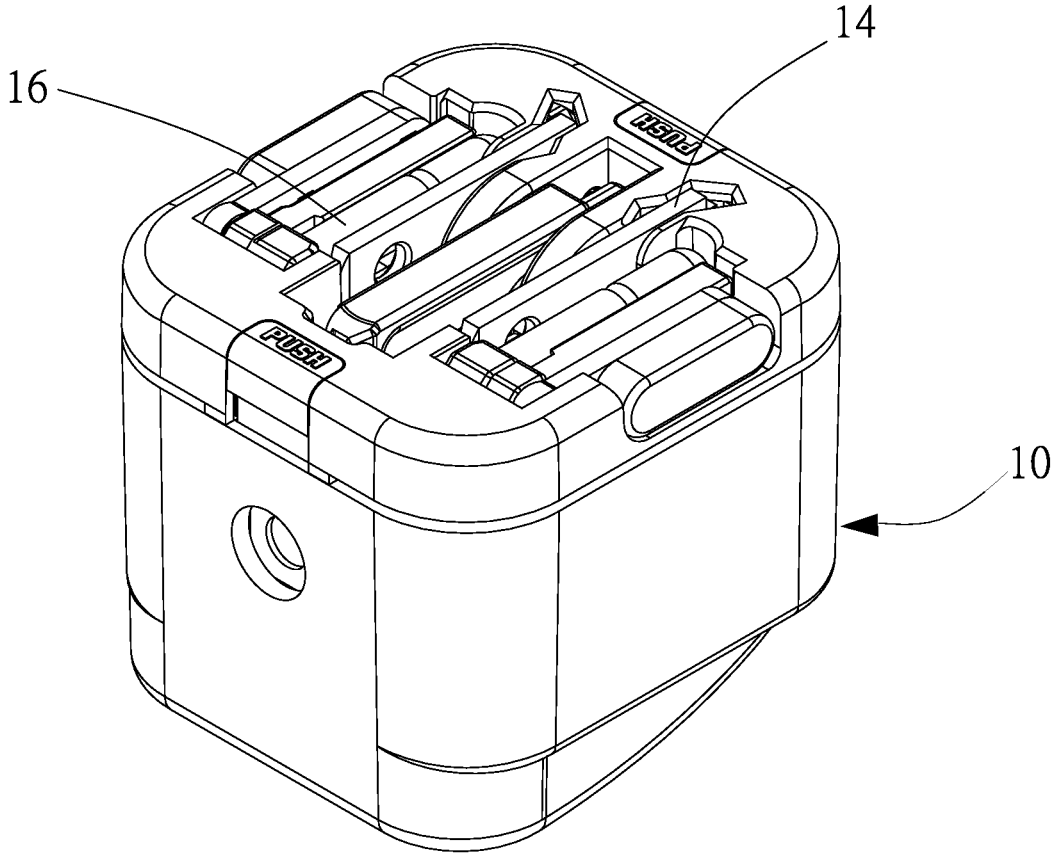
FIG. 1 is a perspective view of a preferred embodiment of the present invention.
Figure 2:
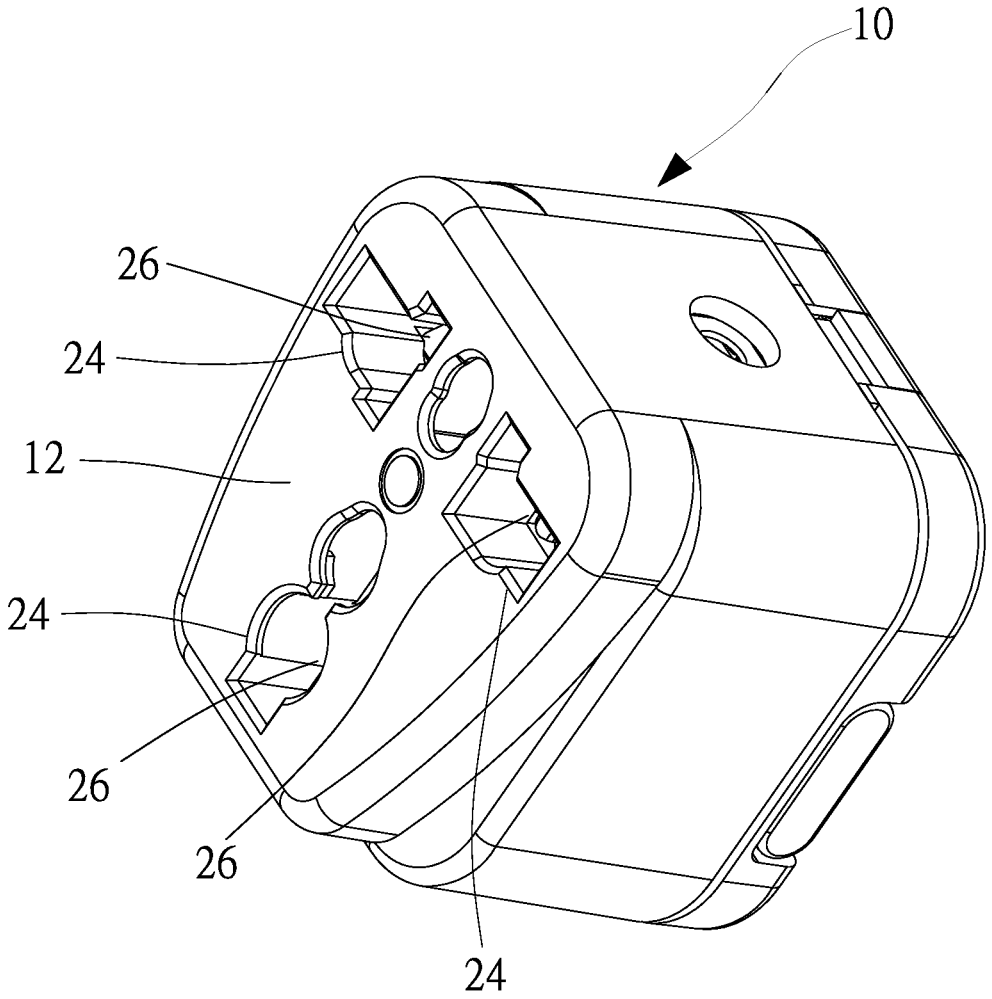
FIG. 2 is a perspective view of a preferred embodiment of the present invention from another angle of view.
Figure 3:
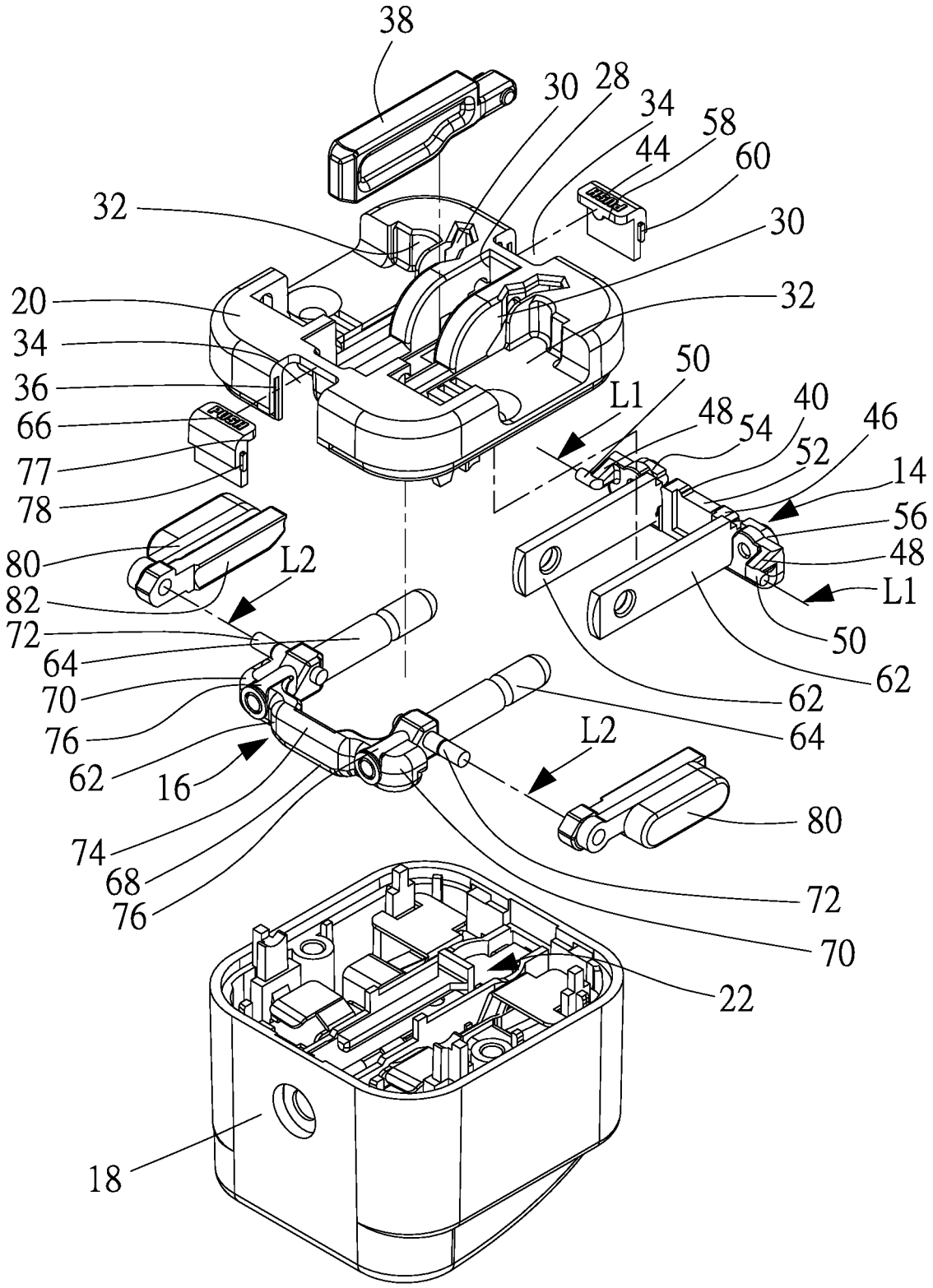
FIG. 3 is an exploded view of a preferred embodiment of the present invention.

First, please refer to FIG. 1 to FIG. 3. FIG. 1 and FIG. 2 are respectively perspective views of a universal adapter structure of a preferred embodiment of the present invention from different angles of view, and FIG. 3 is an exploded view of a universal adapter structure of a preferred embodiment of the present invention. A universal adapter structure comprises a housing 10, a socket unit 12, a first plug unit 14, and a second plug unit 16.

The housing 10 has a shell member 18 and a cover member 20. The shell member 18 has an accommodating space 22 therein and an opening at one end. A plurality of socket openings 24 are provided on a bottom surface of the shell member 18. The socket unit 12 is disposed in the accommodating space 22 of the shell member 18 and has a plurality of socket terminals 26 corresponding to the socket openings 24. The cover member 20 is installed at the opening of the shell member 18 and capable of sealing the accommodating space 22. A ground terminal slot 28 is provided on an outer surface of the cover member 20, a first plug terminal slot 30 is provided by each of two sides of the ground terminal slot 28, and a second plug terminal slot 32 is provided at an outer side of the two first plug terminal slots 30 respectively. The cover member 20 is provided with a notch 34 respectively on two sides along an extending direction of the ground terminal slot 28. A track 36 is provided on two opposite side walls of the notch 34 respectively. A ground terminal 38 corresponding to the British plug standard is pivotally disposed in the ground terminal slot 28. When stowing, flip the ground terminal 38 inward into the ground terminal slot 28; when in use, flip the ground terminal 38 outward to an upright state.

The first plug unit 14 comprises a first rocking base 40, two first plug terminals 42, and a first driving member 44. The first rocking base 40 is an approximately U-shaped element, and has a first main section 46, and two first extend sections 48 located at two ends of the first main section 46 respectively and extending along a direction approximately perpendicular to the first main section 46. The two first extend sections 48 respectively have a first shaft 50 extending outward, and the two first shafts 50 extend along a first axial direction L1. A first driving portion 52 is provided at a center of the first main section 46, and a first fixing portion 54 is provided on each side of the first driving portion 52. The first driving portion 52 is not in the first axial direction L1 and is spaced a predetermined distance from the first axial direction L1. In this embodiment, the two first fixing portions 54 are two screw holes provided on the first rocking base 40, two locking members 56 pass through the two first plug terminals 42 respectively, and then are locked into the screw holes respectively, so that the two first plug terminals 42 are fixed to the first fixing portions 54 respectively; and in this embodiment, the two locking members 56 are bolts.

The first rocking base 40 is disposed below the cover member 20 and is pivotally connected to the shell member 18 by the two first shafts 50 so that the first driving portion 52 is located at the notch 34, and the two first plug terminals 42 pass through a hole of the cover member 20 and extend into the two first plug terminal slots 30 respectively. The two first plug terminals 42 are respectively electrically connected to the two socket terminals 26. The first driving member 44 is an approximately L-shaped plate, and is disposed in the notch 34 of the housing 10. An inner side of the first driving member 44 is disposed with a first butting portion 58 corresponding to the first driving portion 52 of the first rocking base 40, and a first guide portion 60 is provided on each of two lateral end faces of the first driving member 44. The two first guide portions 60 are combined with the two tracks 36 respectively, so that the first driving member 44 is slidably disposed in the notch 34 of the housing 10 along the two tracks 36.

Figure 4:
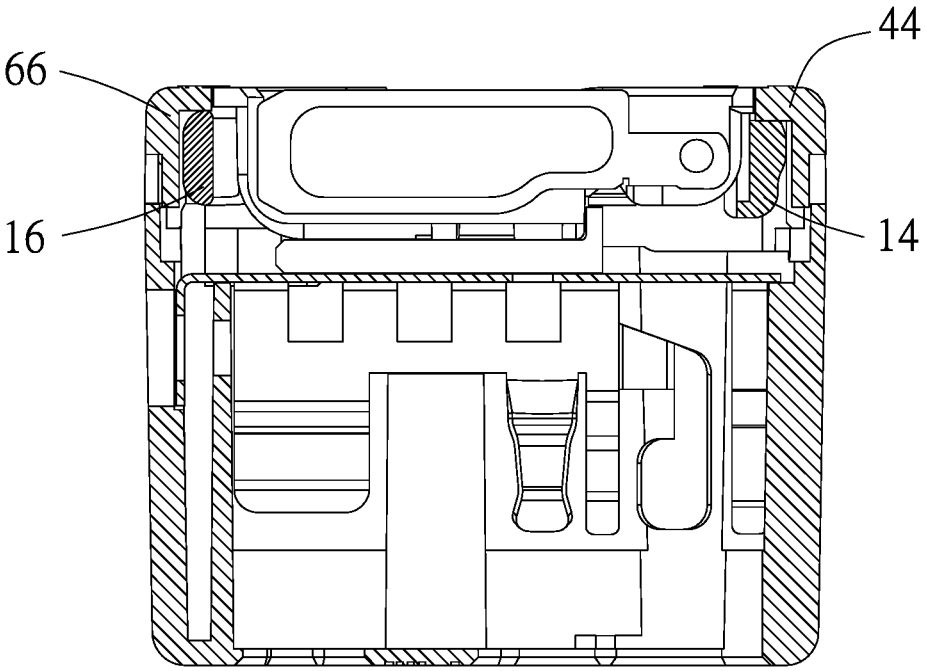
FIG. 4 is a sectional view of a preferred embodiment of the present invention showing a first plug unit and a second plug unit in a stowed state.
Figure 5:
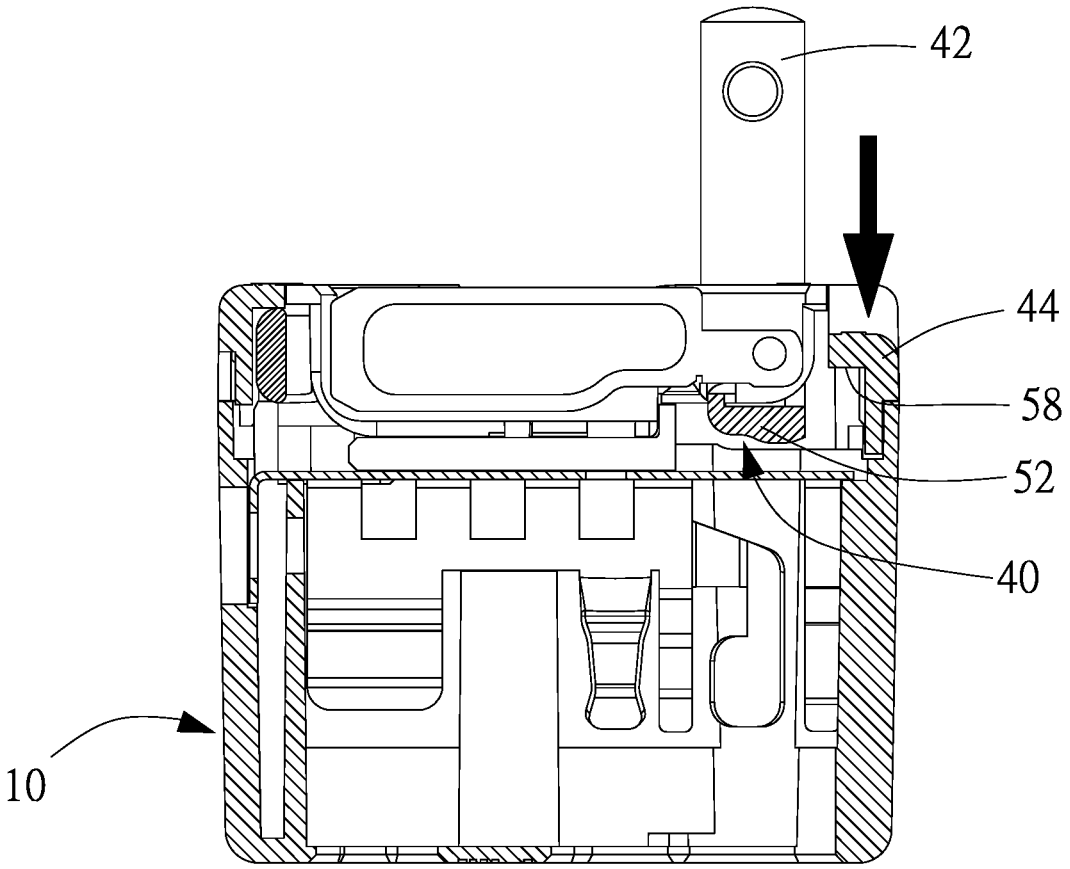
FIG. 5 is a sectional view of a preferred embodiment of the present invention showing the first plug unit being switched to a ready-to-use state.

Please refer to FIG. 1 and FIG. 4. FIG. 4 is a sectional view of the structure of the universal adapter structure. In an initial state, the first driving member 44 is not pressed, and the two first plug terminals 42 are located in a stowed position accommodated in the two first plug terminal slots 30. Then, as shown in FIG. 5, when the first driving member 44 is pressed and moved downward, the first butting portion 58 will press against the first driving portion 52 of the first rocking base 40 to apply a torque to the first rocking base 40 and to pivot the first rocking base 40, thereby causing outer ends of the two first plug terminals 42 to pivot toward a direction away from the housing 10, to leave the two first plug terminal slots 30 and to rotate toward a ready-to-use position in an upright state. In this embodiment, the two first plug terminals 42 are capable of rotating outward at a predetermined angle by pressing the first driving member 44. At this time, the outer ends of the two first plug terminals 42 have left the two first plug terminal slots 30. After that, a user can continue to move the two first plug terminals 42 to the ready-to-use position.

Please refer to FIGS. 1 and 3 again. The second plug unit 16 comprises a second rocking base 62, two second plug terminals 64 and a second driving member 66. The second rocking base 62 is an approximately U-shaped element, and has a second main section 68, and two second extend sections 70 located at two ends of the second main section 68 respectively and extending along a direction approximately perpendicular to the second main section 68. The two second extend sections 70 respectively have a second shaft 72 extending outward, and the two second shafts 72 extend along a second axial direction L2. A second driving portion 74 is provided at a center of the second main section 68, and a second fixing portion 76 is provided on each side of the second driving portion 74. The second driving portion 74 is not in the second axial direction L2 and is spaced a predetermined distance from the second axial direction L2. In this embodiment, the two second fixing portions 76 are two tubes provided on the second rocking base 62, and the second plug terminals 64 are respectively inserted into the tubes and fixed.

The second rocking base 62 is disposed below the cover member 20, is located on a side opposite of the first rocking base 40, and is pivotally connected to the shell member 18 by the two second shafts 72 so that the second driving portion 74 is located at the other notch 34, and the two second plug terminals 64 pass through a hole of the cover member 20 and extend into the two second plug terminal slots 32 respectively. The two second plug terminals 64 are respectively electrically connected to the two socket terminals 26. The second driving member 66 is an approximately L-shaped plate, and is disposed in the notch 34 of the housing 10. An inner side of the second driving member 66 is disposed with a second butting portion 77 corresponding to the second driving portion 74 of the second rocking base 62, and a second guide portion 78 is provided on each of two lateral end faces of the second driving member 66. The two second guide portions 78 are combined with the two tracks 36 respectively, so that the second driving member 66 is slidably disposed in the notch 34 of the housing 10 along the two tracks 36.

Figure 6:
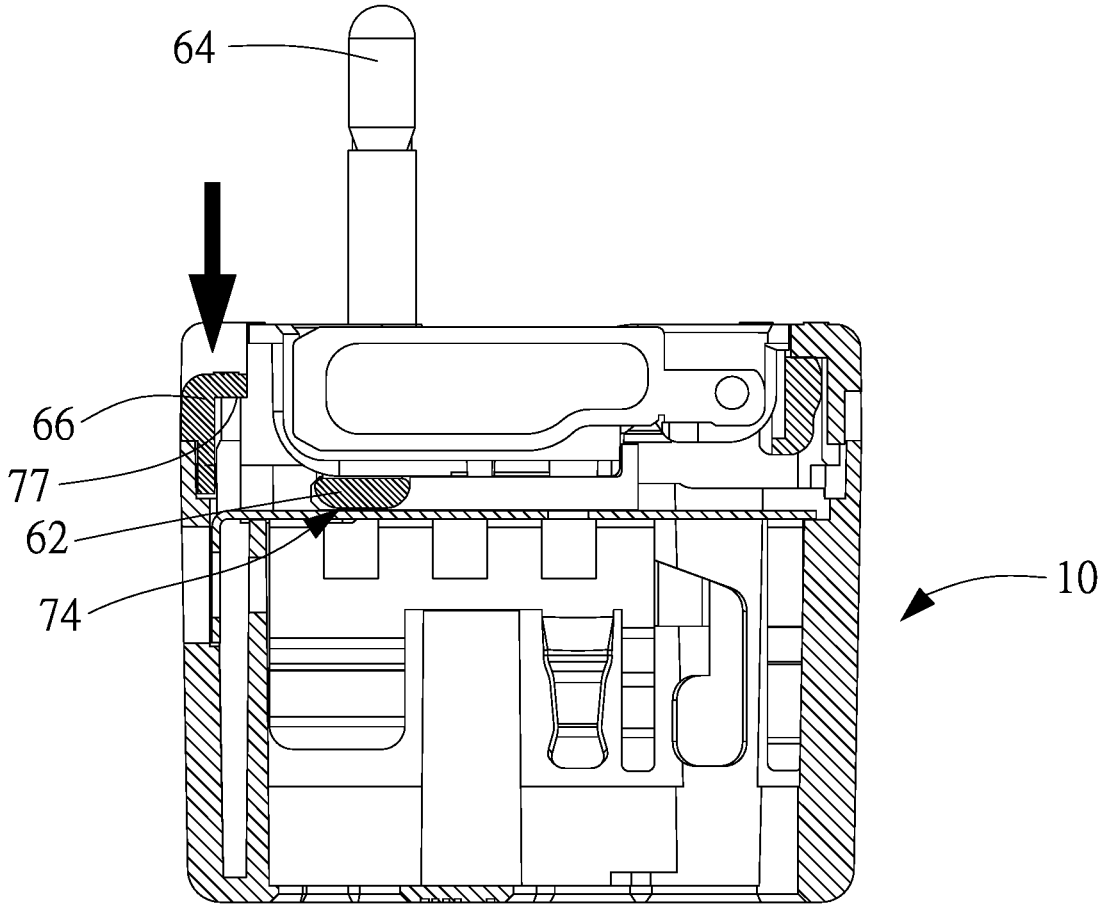
FIG. 6 is a sectional view of a preferred embodiment of the present invention showing the second plug unit being switched to a ready-to-use state.

Same as the aforementioned, please refer to FIG. 1 and FIG. 4 again. In an initial state, the second driving member 66 is not pressed, and the two second plug terminals 64 are located in a stowed position accommodated in the two second plug terminal slots 32. Then, as shown in FIG. 6, when the second driving member 66 is pressed and moved downward, the second butting portion 77 will press against the second driving portion 74 of the second rocking base 62 to apply a torque to the second rocking base 62 and to pivot the second rocking base 62, thereby causing outer ends of the two second plug terminals 64 to pivot toward a direction away from the housing 10, to leave the two second plug terminal slots 32 and to rotate toward a ready-to-use position in an upright state. In this embodiment, the two second plug terminals 64 are capable of rotating outward at a predetermined angle by pressing the second driving member 66. At this time, the outer ends of the two second plug terminals 64 have left the two second plug terminal slots 32. After that, the user can continue to move the two second plug terminals 64 to the ready-to-use position. In addition, a pivoting direction of the first plug terminal 42 of the first plug unit 14 is opposite to a pivoting direction of the second plug terminal 64 of the second plug unit 16.

Figure 7:
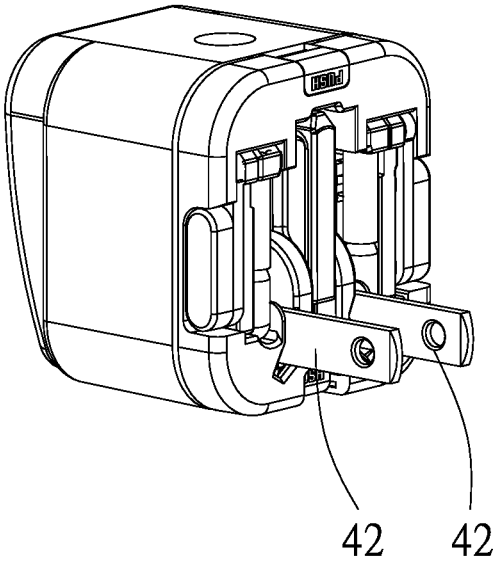
FIG. 7 is a perspective view of a preferred embodiment of the present invention showing a first plug type.

Then, please refer to FIG. 7, which shows a first plug type of the universal adapter structure. In this embodiment, the two first plug terminals 42 are two parallel plates, forming a plug suitable for use in Taiwan, Japan, the United States, and the like.

Figure 8:
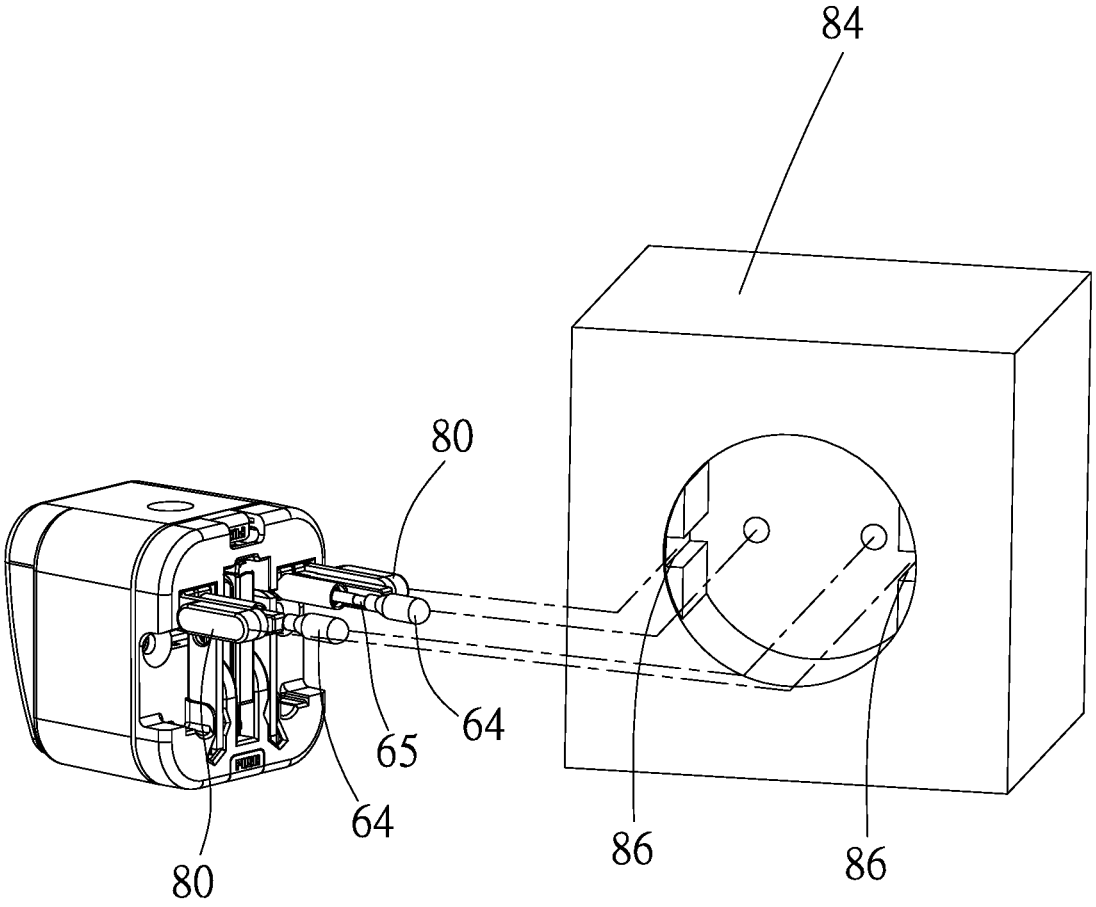
FIG. 8 is a perspective view of a preferred embodiment of the present invention showing a second plug type.

Furthermore, please refer to FIG. 3 and FIG. 8. FIG. 8 shows a second plug type of the universal adapter structure. In this embodiment, the second plug unit 16 further has two auxiliary ribs 80, each of the two auxiliary ribs 80 has a hole, and the two second shafts 72 of the second rocking base 62 pass through the two holes respectively to pivotally dispose the two auxiliary ribs 80 on the second rocking base 62, and to cause the two auxiliary ribs 80 to be located on outer sides of the two second plug terminals 64 respectively. Each of the two auxiliary ribs 80 has a slot 82 facing one of the two second plug terminals 64, so that a portion of each of the two second plug terminals 64 is located in the slot 82 respectively, resulting in the two auxiliary ribs 80 moving together with the two second plug terminals 64. In addition, each of the second plug terminals 64 has an auxiliary extend section 65, which is extended outwardly or retracted and fixed inwardly by rotation. Please refer to FIG. 8, when the two second plug terminals 64 and the two auxiliary ribs 80 are rotated to a ready-to-use position, a plug suitable for the European region will be formed. When the universal adapter structure is inserted into a European socket 84 of a European country, the two auxiliary ribs 80 are inserted in two slots 86 of the European socket 84 to improve the stability of the adapter when combining with the European socket 84.

In summary, the present invention utilizes the design of the first driving member and the second driving member to change the conventional operation method of pulling out the plug terminals with a finger into the method of pressing the driving member, so that the plug terminals are flipped to a ready-to-use state to provide a more convenient operation mode; and utilizes the design of the auxiliary ribs to improve the stability of the universal adapter when combined with the socket, and to solve the problem of the lack of robustness of the conventional square adapter when used in European sockets.

It is to be understood that the above description is only preferred embodiments of the present invention and is not used to limit the present invention, and changes in accordance with the concepts of the present invention may be made without departing from the spirit of the present invention, for example, the equivalent effects produced by various transformations, variations, modifications and applications made to the configurations or arrangements shall still fall within the scope covered by the appended claims of the present invention.

What is claimed is:

1. A universal adapter structure at least comprising:

a housing having an accommodating space therein, and a plurality of socket openings on one side;

a socket unit having a plurality of socket terminals, the socket terminals being located in the accommodating space of the housing and corresponding to the socket openings respectively; and a first plug unit disposed on the housing and having a first rocking base, a plurality of first plug terminals and a first driving member, the first rocking base having a first shaft, a first driving portion and a plurality of first fixing portions, the first rocking base being pivotally disposed to the housing with the first shaft and along a first axial direction, the first driving portion being spaced a predetermined distance from the first axial direction, the first plug terminals being connected to the first fixing portions of the first rocking base, and being electrically connected to the socket terminals of the socket unit respectively, the first driving member being movably disposed on the housing, the first driving member having a first butting portion corresponding to the first driving portion of the first rocking base; wherein after the first driving member is moved, the first butting portion is pressed against the first driving portion of the first rocking base to apply a torque to the first rocking base and to pivot the first rocking base, thereby causing outer ends of the two first plug terminals to pivot toward a direction away from the housing.

2. The universal adapter structure as claimed in claim 1, wherein the housing is provided with a track, the first driving member is provided with a first guide portion combined with the track, so that the first driving member moves along the track.

3. The universal adapter structure as claimed in claim 1, wherein the housing is provided with a notch, and the first driving member is disposed in the notch.

4. The universal adapter structure as claimed in claim 1, wherein the housing is provided with a plurality of first plug terminal slots, in an initial state, the first plug terminals are accommodated in the first plug terminal slots.

5. The universal adapter structure as claimed in claim 1, wherein the first rocking base of the first plug unit has a first main section and two first extend sections located at two ends of the first main section respectively and extending along a direction approximately perpendicular to the first main section, the first driving portion and the first fixing portion are disposed on the first main section, and the two first extend sections are respectively provided with the first shaft.

6. The universal adapter structure as claimed in claim 1, wherein the first fixing portion is a screw hole, a locking member passes through the first plug terminal, and then is locked into the screw hole.

7. The universal adapter structure as claimed in claim 1, wherein further comprising a second plug unit disposed on the housing, the second plug unit having a second rocking base, a plurality of second plug terminals, and a second driving member, the second rocking base having a second shaft, a second driving portion, and a plurality of second fixing portions, the second rocking base being pivotally disposed to the housing with the second shaft and along a second axial direction, the second driving portion being spaced a predetermined distance from the second axial direction, the second plug terminals being connected to the second fixing portions of the second rocking base, and being electrically connected to the socket terminals of the socket unit respectively, the second driving member being movably disposed on the housing, the second driving member having a second butting portion corresponding to the second driving portion of the second rocking base;

after the second driving member being moved, the second butting portion being pressed against the second driving portion of the second rocking base to apply a torque to the second rocking base and to pivot the second rocking base, thereby causing outer ends of the two second plug terminals to pivot toward a direction away from the housing.

8. The universal adapter structure as claimed in claim 7, wherein a pivoting direction of the first plug terminal of the first plug unit is opposite to a pivoting direction of the second plug terminal of the second plug unit.

9. The universal adapter structure as claimed in claim 7, wherein the housing is provided with a track, the second driving member is provided with a second guide portion combined with the track, so that the second driving member moves along the track.

10. The universal adapter structure as claimed in claim 7, wherein the housing is provided with a notch, and the second driving member is disposed in the notch.

11. The universal adapter structure as claimed in claim 7, wherein the housing is provided with a plurality of second plug terminal slots, in an initial state, the second plug terminals are accommodated in the second plug terminal slots.

12. The universal adapter structure as claimed in claim 7, wherein the second rocking base of the second plug unit has a second main section and two second extend sections located at two ends of the second main section respectively and extending along a direction approximately perpendicular to the second main section, the second driving portion and the second fixing portion are disposed on the second main section, and the two second extend sections are respectively provided with the second shaft.

13. The universal adapter structure as claimed in claim 7, wherein the second fixing portions are respectively a tube, and the second plug terminals are respectively inserted into the tubes and fixed.

14. The universal adapter structure as claimed in claim 7, wherein the second plug unit further comprises a plurality of auxiliary ribs pivotally disposed on the second rocking base, and the auxiliary ribs abut the second plug terminals.

15. The universal adapter structure as claimed in claim 14, wherein each of the auxiliary ribs has a slot facing one of the second plug terminals, so that a portion of each of the second plug terminals is located in the slot of the auxiliary rib respectively.

16. The universal adapter structure as claimed in claim 1, further comprising a ground terminal pivotally disposed on the housing.

17. The universal adapter structure as claimed in claim 16, wherein the housing is provided with a ground terminal slot, in an initial state, the ground terminal is accommodated in the ground terminal slot.

* * * * *